United States Patent [19]

Bell

[11] Patent Number: 5,024,620

[45] Date of Patent: Jun. 18, 1991

[54] BATTERY TERMINAL POST CLAMP

[76] Inventor: Joseph Bell, 52 Pluto Cir., N. Fort Myers, Fla. 33903

[21] Appl. No.: 535,597

[22] Filed: Jun. 11, 1990

[51] Int. Cl.[5] ..... H01R 4/48

[52] U.S. Cl. ..... 439/759; 439/829

[58] Field of Search ..... 439/754, 759, 909, 506, 439/502, 731, 805, 822, 829

[56] References Cited

U.S. PATENT DOCUMENTS

| | | | |
|---|---|---|---|
| 4,178,052 | 12/1979 | Ekbom et al. | 439/829 |
| 4,206,960 | 6/1980 | Tantillo et al. | 439/829 |
| 4,256,361 | 3/1981 | Bell | 439/759 |
| 4,674,817 | 6/1987 | Olms | 439/592 |

*Primary Examiner*—Paula A. Bradley

*Attorney, Agent, or Firm*—Hill, Van Santen, Steadman & Simpson

[57] ABSTRACT

A spring actuated battery clamp has a pair of cooperable clamp members disposed in side-by-side relation, one of the clamp members being adapted to be connected to the end of a battery cable. The clamp member includes a torsion spring to provided clamping forces to a battery terminal post and an alignment structure for the clamping jaws is provided in the form of dove tail arrangement of a dove tail recess at the terminus of one jaw and a cooperable dove tail projection at the terminus of the other jaw. Alternatively, the dove tail structure may be provided at the opposite side of the torsion spring.

3 Claims, 1 Drawing Sheet

FIG. 1
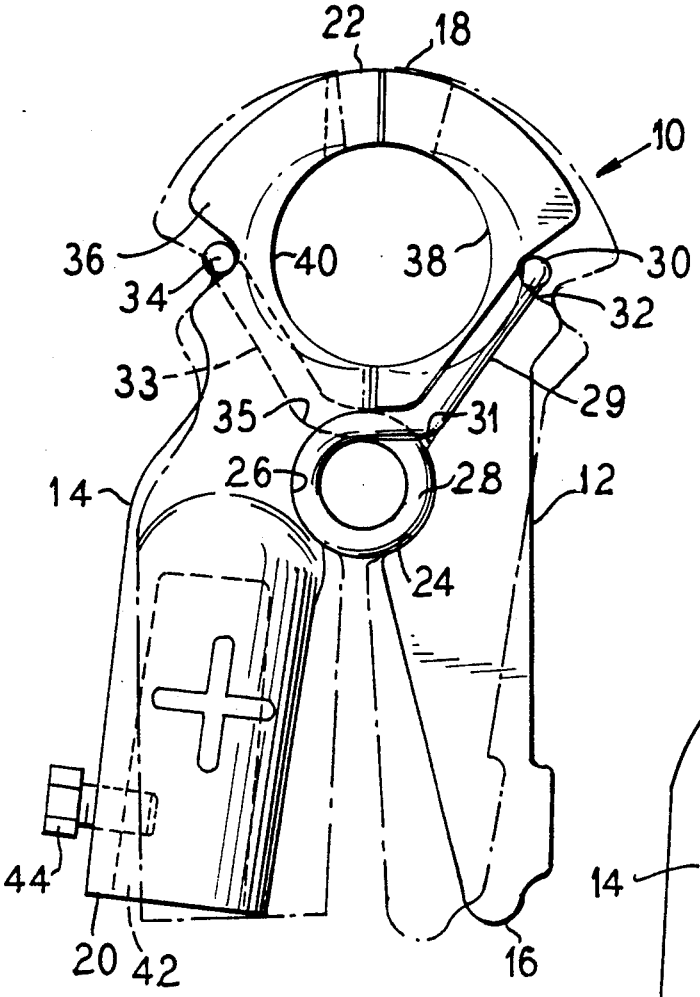
FIG. 3
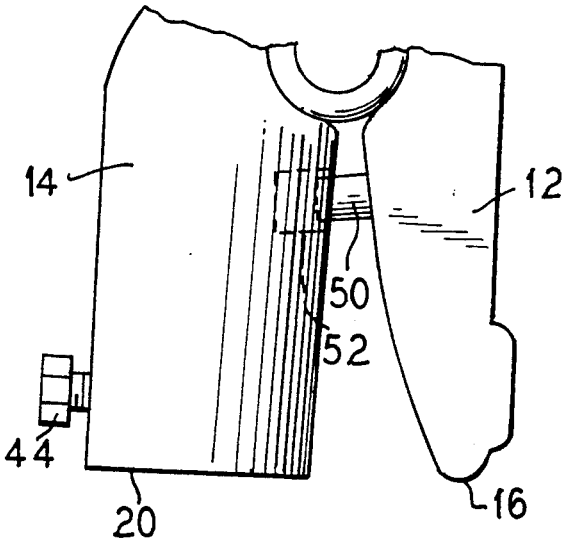
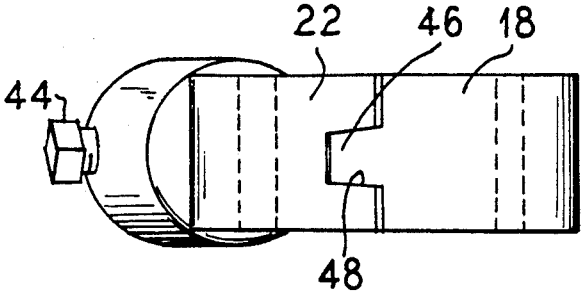
FIG. 2

BATTERY TERMINAL POST CLAMP

BACKGROUND OF THE INVENTION

1. Field of the Invention

The present invention relates to battery terminal or post clamps and is particularly concerned with such a clamp for quick attachment and quick release.

2. Description of the Prior Art

In the past, battery terminal clamps have generally been constructed as comprising a pair of jaws adapted to engage about a battery terminal post and to be tightened thereagainst by bolts.

As pointed out in my U.S. Pat. Nos. 4,256,361 and 4,429,944, both fully incorporated herein by this reference, clamp structures employing two separate clamping members have previously been produced, as for example, such as illustrated in U.S. Pat. No. 2,285,545 issued June 9, 1942 and U.S. Pat. No. 2,020,220, issued November 5, 1935. Both of these clamp structures employ two clamp members, utilizing springs to provide the clamping forces on a cooperable battery terminal or the like. As pointed out in my aforementioned patents, both of these structures require tools to effect a disconnection or a connection. In U.S. Pat. No. 2,285,545, for example, a screw driver or similar tool is required, for disposition between the two free ends of the clamp member adjacent the jaws of the latter, whereby the latter may be separated by twisting the blade of the screw driver. In U.S. Pat. No. 2,020,220, provision is made for engagement with a pair of pliers or the like at the opposite free ends of the clamping member to effect a compression of the actuating spring to open the jaws.

SUMMARY OF THE INVENTION

The present invention provides a structure which is basically similar to that of my two aforementioned patents. In U.S. Pat. No. 4,256,361, I provide a pair of clamping jaws which are disposed in a side-by-side non-crossing relation with each jaw having a recess in its opposing face, the recesses being generally semi-cylindrical and aligned to form a generally cylindrical bore in the assembled structure and a torsion spring is disposed in the bore and has a pair of ends extending to be received in a respective recess of a jaw. Each of the jaws includes another recess which, together with the corresponding recess at the other jaw forms a generally cylindrical opening for receiving a battery terminal post which is clamped therein by the forces exerted by the spring.

A pair of opposed slots are provided in the two jaws and a strip of metal is force fit in one of the slots and free to slide in the other of the slots. This structure maintains the jaws in alignment.

In my U.S. Pat. No. 4,429,944, the same basic structure is provided with the exception that a V-shaped spring has one leg force fit in a slot in one of the clamp members and another leg force fit in a corresponding slot of the other clamp member. This spring provides the clamping forces and the alignment of the clamping members in place of the spring and the metal strip in my U.S. Pat. No. 4,256,361.

It is the object of the present invention to provide a battery terminal post clamp of the type set forth above which has the advantage of the spring force of the torsion spring over that of the V-shaped spring while at the same time maintaining alignment of the jaws with an integral jaw structure which does not require the machining of slots and the assembly therein of an alignment strip.

In other words, the present invention is to have the advantages of my aforementioned U.S. Pat. No. 4,256,361, without requiring the additional manufacturing steps involved in providing for and the assembly of the alignment structure.

BRIEF DESCRIPTION OF THE DRAWING

Other objects, features and advantages of the invention, its organization, construction and operation will be best understood from the following detailed description, taken in conjunction with the accompanying drawings, on which:

FIG. 1 is a plan view of a battery terminal post clamp constructed in accordance with the present invention;

FIG. 2 is a top view of the battery terminal clamp of FIG. 1 showing one embodiment of an integral alignment structure; and FIG. 3 is a fragmentary plan view of the lower portion of the structure of FIG. 1 illustrating another embodiment of the alignment structure.

DESCRIPTION OF THE PREFERRED EMBODIMENTS

Referring to FIG. 1, a battery terminal post clamp is generally illustrated at 10 as comprising a pair of side-by-side clamp members 12 and 14. The clamp member 12 includes a proximal end 16 and a distal end 18, while the clamp member 14 includes a proximal end 20 and a distal end 22.

The clamp 12 includes a generally semi-cylindrical recess 24 and the clamp member 14 includes a similar semi-cylindrical recess 26, the recesses 24 and 26 together forming a cylindrical recess for receiving a torsion spring 28.

The torsion spring 28 includes an arm 29 received in a groove 31 and a first terminal end 30 received in a recess 32 of the clamp member 12 and, correspondingly, a terminal end 34 terminates an arm 33 received in a groove 35, the end 34 received in a recess 36 in the clamp member 14. The disposition of the spring 28 and the extension of the spring arms to the ends thereof cause clamping forces to be applied to the upper portions of the clamp members 12 and 14.

The upper portion or jaw of the clamp member 12 includes a generally semi-cylindrical recess 38 and the opposed jaw of the clamp member 14 includes a generally semi-cylindrical recess 40. The recesses 38 and 40 are tapered for adaptation to the respective positive or negative battery terminal posts and together form a generally cylindrical structure, actually a truncated conical structure, for receiving the respective battery terminal post.

The clamp member 14 includes a recess 42 which may comprise an elongate coiled spring of square cross-section wire for threadedly receiving and contacting an electrical conductor. The conductor may be attached by such a spring or any other suitable means as, for example, soldering, swedging and the like. In addition, a machine screw 44 may be provided to press against and secure the conductor to the clamp member 14.

At the distal end of the battery terminal post clamp, namely at the distal ends 18 and 22 of the clamp members 12 and 14, an alignment and alignment structure is provided in the form of a recess 48 in the distal end 22 and a projection 46 extending from the distal end 18. As shown, the recess 48 and the projection 46 are tapered in the form of a dovetail structure. When the jaws are opened by moving the proximal ends 16 and 20 toward one another and flexing the spring 28, the dovetail projection 46 should preferably not move completely out of the recess 48 so that, upon release of the proximal ends 16 and 20, the restoring force of the spring 28 causes the jaws to move towards one another with the tapered or ramp surfaces of the dovetail structure guiding the jaws into alignment.

An alternative alignment structure is illustrated in FIG. 3 as again comprising a dovetail structure in which the dovetail projection 50 extends from the lower portion of the clamp member 12 and does not completely exit a tapered recess 52 in the corresponding section of the clamp member 14 in response to the restoring force of the spring 28.

Both alignment structures could, of course, be provided in a single battery terminal clamp device. Inasmuch as the dovetail projections and the dovetail recesses may be formed during a casting operation of the clamp members 12 and 14, the machining of slots and the like and the provision of a force fit of an alignment strip have been eliminated.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. A battery cable connector comprising:

first and second arcuate jaws each comprising a periphery, first and second side faces, a first recess extending between said first and second side faces facing the like first recess to form a generally cylindrical first bore for receiving a battery terminal post, a second recess spaced from said first recess and each extending between said first and second side faces and facing the like second recess to form a generally cylindrical second bore, a third recess in said periphery extending between said first and second side faces, and a groove in said first side face extending from said second recess to said third recess;

a pair of operating arms, each of said operating arms connected to a respective arcuate jaw, said operating arms extending divergently from said first and second arcuate jaws;

a spring including a spring coil mounted in said second cylindrical bore and a pair of spaced apart spring arms connected to said spring coil and located in respective ones of said grooves, each of said spring arms including a distal end portion extending at approximately a right angle thereto and located in and extending along and providing even forces along the length of the respective third recess;

said spring mounted to normally urge said jaws towards one another, and second operating arms movable towards one another against the force of said spring to open said jaws;

connection means on one of said operating arms for connecting a battery cable thereto; and alignment aiding means including a first distal end on said first arcuate jaw, a second distal end on said second arcuate jaw, a tapered projection extending from said first distal end towards said second distal end, and recess means defining a tapered recess in said second distal end receiving and maintaining said tapered projection therein to aid in maintaining alignment of said jaws.

2. A battery cable connector comprising:

first and second arcuate jaws each comprising a periphery, first and second side faces, a first recess extending between said first and second side faces facing the like first recess to form a generally cylindrical first bore for receiving a battery terminal post, a second recess spaced from said first recess and extending between said first and second side faces and facing the like second recess to form a generally cylindrical second bore, a third recess in said periphery extending between said first and second side faces, and a groove in said first side face extending from said second recess to said third recess;

a pair of operating arms, each of said operating arms connected to a respective arcuate jaw, said operating arms extending divergently from said arcuate jaws;

a spring including a spring coil mounted in said second cylindrical bore and a pair of spaced apart spring arms connected to said spring coil and located in respective ones of said grooves, each of said spring arms including a distal end portion extending at approximately a right angle thereto and located in and extending along and providing even forces along the length of the respective third recess;

said spring mounted stressed to normally urge said jaws towards one another and said operating arms moveable towards one another against the force of said spring to open said jaws;

connection means on one of said operating arms for connecting a battery cable thereto; and alignment aiding means including a tapered projection extending from one of said operating arms towards the other operating arm, recess means defining a tapered recess in said other operating arm for receiving and maintaining said tapered projection therein.

3. A battery cable connector comprising:

first and second arcuate jaw each comprising a periphery, first and second side faces, a first recess extending between said first and second side faces and facing the like first recess to form a generally cylindrical first bore for receiving a battery terminal post, a second recess spaced from said first recess and extending between said first and second side faces and facing the like second recess to form a generally cylindrical second bore, a third recess in said periphery extending between said first and second side faces, and a groove in said first side face extending from said second recess to said third recess;

a pair of operating arms, each of said operating arms connected to a respective arcuate jaw, said operating arms extending divergently from said first and second arcuate jaws;

a spring including a spring coil mounted in said second cylindrical bore and a pair of spaced apart spring arms connected to said spring coil and located in respective ones of said grooves, each of said spring arms including a distal end portion extending a approximately a right angle thereto and located in and extending along and providing even forces along the length of the respective third recess;

said spring mounted stressed to normally urge said jaws towards one another and said operating arms movable towards one another against the force of said spring to open said jaws;

connection means on one of said operating arms for connecting a battery cable thereto; and alignment aiding means including a first distal end on said first arcuate jaw, a second distal end on said second arcuate jaw, a first tapered projection extending from said first distal end towards said second distal end, first recess means defining a first tapered recess in said second distal end and receiving and maintaining said first tapered projection therein to aid in maintaining alignment of said jaws, a second tapered projection extending from one of said operating arms towards the other of said operating arms, second recess means defining a second tapered recess in said other operating arms for receiving and maintaining said tapered projection therein.

* * * * *